US008782980B1

(12) United States Patent
Fajardo

(10) Patent No.: US 8,782,980 B1
(45) Date of Patent: Jul. 22, 2014

(54) PROTECTIVE DEVICE FOR COVERING THE TIP OF A BEAM ON WHICH AIR CONDITIONING EQUIPMENT IS INSTALLED

(71) Applicant: Jose C. Fajardo, Miami, FL (US)

(72) Inventor: Jose C. Fajardo, Miami, FL (US)

( * ) Notice: Subject to any disclaimer, the term of this patent is extended or adjusted under 35 U.S.C. 154(b) by 0 days.

(21) Appl. No.: 13/952,008

(22) Filed: Jul. 26, 2013

Related U.S. Application Data

(60) Provisional application No. 61/796,384, filed on Nov. 9, 2012.

(51) Int. Cl.
*E04H 12/00* (2006.01)
*B65D 59/06* (2006.01)

(52) U.S. Cl.
CPC ..... *B65D 59/06* (2013.01)
USPC ..... 52/301

(58) Field of Classification Search
CPC ... Y10S 52/08; Y10S 256/05; Y10S 248/915; Y10S 285/901; E04C 5/161; E04C 3/125; E04C 2003/043; E04B 9/005; E04B 2/7854; E04B 2002/742; E04H 2017/006; E04H 12/22; E04G 21/32; B65D 59/06
USPC ..... 52/300, 301, DIG. 8
See application file for complete search history.

(56) References Cited

U.S. PATENT DOCUMENTS

| | | | | |
|---|---|---|---|---|
| 6,561,499 | B2 * | 5/2003 | Lesenskyj et al. | 256/65.01 |
| 6,662,515 | B2 * | 12/2003 | Buhrts et al. | 52/301 |
| 6,722,637 | B2 * | 4/2004 | Burkart et al. | 256/1 |
| 6,804,921 | B2 * | 10/2004 | Neylon | 52/244 |
| 6,918,213 | B2 * | 7/2005 | Burkart et al. | 52/94 |
| 6,994,327 | B2 * | 2/2006 | Steffes | 256/19 |
| 7,143,556 | B2 * | 12/2006 | Hales | 52/301 |
| 7,992,362 | B2 * | 8/2011 | Petta | 52/848 |
| 8,492,463 | B2 * | 7/2013 | Jung et al. | 524/115 |
| 8,496,223 | B2 * | 7/2013 | Sladojevic et al. | 249/139 |
| 2003/0106273 | A1 * | 6/2003 | Neylon | 52/244 |
| 2003/0160222 | A1 * | 8/2003 | Steffes | 256/1 |

* cited by examiner

*Primary Examiner* — William Gilbert
*Assistant Examiner* — Gisele Ford
(74) *Attorney, Agent, or Firm* — Egbert Law Offices, PLLC

(57) ABSTRACT

The present invention is related to a protective device for covering the tip of beams, especially beams used to install air conditioning units. It comprises a plastic hollow piece with an external smooth surface protection and an internal chamber into which the tip of a beam is fitted. The internal chamber includes upper and lower channels into which the flanges of a beam are inserted, and a central longitudinal partition. Holding means like screws or the like may be used to attach the device to the beam.

7 Claims, 3 Drawing Sheets

PROTECTIVE DEVICE FOR COVERING THE TIP OF A BEAM ON WHICH AIR CONDITIONING EQUIPMENT IS INSTALLED

RELATED U.S. APPLICATIONS

The present application claims priority from U.S. Provisional Application Ser. No. 61/796,384, filed on Nov. 9, 2012.

STATEMENT REGARDING FEDERALLY SPONSORED RESEARCH OR DEVELOPMENT

Not applicable.

REFERENCE TO MICROFICHE APPENDIX

Not applicable.

FIELD OF THE INVENTION

The present invention relates generally to a device with which it is possible to adequately protect the tip of beams, usually metal beams, used to install air conditioning equipment thereon. The invention is, however, more particularly directed to a protective device for covering the tip of beams on which air conditioning equipment is installed.

DESCRIPTION OF RELATED ART INCLUDING INFORMATION DISCLOSED UNDER 37 CFR 1.97 AND 37 CFR 1.98

At present, most buildings have air conditioning equipment installed on the roof of the common areas of the building. The installation of the condensation unit, in particular, needs to be installed by following certain rules and regulations. As part of these rules, at least two metallic beams should be fixed to the floor and on which the unit is supported. Each beam is usually an I-beam with a central web and two horizontal flanges. The tip of each beam includes sharp edges which are dangerous for those involved in doing the maintenance on these units.

Sometimes, these units are installed in places with restricted free space around. When the technician in charge of maintaining the unit must access the place where the unit is installed, he/she has to walk around it. During these maneuvers, it is common to have accidents that can usually cause cuts ranging from slight to severe with the sharp edges of the I-beams.

To the best knowledge of the inventor, there are no devices in the prior an for protecting these sharp edges of the I-beams to prevent these types of accidents.

BRIEF SUMMARY OF THE INVENTION

This invention is directed to a protective device for covering the tip of beams on which air conditioning equipment is installed comprising a plastic cover adapted to fit in the tip of I-beam.

In one general aspect of the present invention, a protective device for covering the tip of beams comprises basically a plastic hollow piece with two channels for fitting the flanges of the I-beam and an internal rib to support the web of the beam.

Accordingly, it is a primary object of the present invention to provide a protective device for covering the tip of beams, protecting adults and children with access to the place in which the air conditioner is installed from possible injuries infringed by the sharp edges of those beams.

Another aspect of the present invention provides a plastic protective device covering each free end of the beams on which air conditioners are installed. Once installed, this plastic cover will provide a smooth harmless surface instead of sharp and dangerous edges.

The advantages of the present invention may be summarized as:

- Long-lasting acrylonitrile butadiene styrene (ABS) plastic end cover protects contractors from injuries from sharp edges;
- It protects home/business owners from injuries;
- The device is applicable to new and existing construction jobs;
- It is code compliant;
- The decorative finish provides clean and complete installation:
- It is available in different colors.

In summary, the present invention is related to a protective device for covering the tip of beams, comprising a plastic hollow piece with an external smooth surface protection and an internal chamber into which the tip of an I-beam is fitted. The internal chamber includes upper and lower channels into which the flanges of a beam can be inserted, and a central longitudinal partition. Holding means may be used to attach the device to the beam.

These and other aspects, features, and advantages of the present invention will become more readily apparent from the attached drawings and the detailed description of the preferred embodiments, which follow.

BRIEF DESCRIPTION OF THE SEVERAL VIEWS OF THE DRAWINGS

The preferred embodiments of the invention will hereinafter be described in conjunction with the appended drawings provided to illustrate and not to limit the invention, where like designations denote like elements, and in which.

DETAILED DESCRIPTION OF THE INVENTION

The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the an to make or use the embodiments of the disclosure and are not intended to limit the scope of the disclosure, which is defined by the claims. For purposes of description herein, the terms "upper", "lower", "left", "rear", "right", "front", "vertical", "horizontal", and derivatives thereof shall relate to the invention as oriented in FIG. 1. Furthermore, there is no intention to be bound by any expressed or implied theory presented in the preceding technical field, background, brief summary or the following detailed description. It is also to be understood that the specific devices illustrated in the attached drawings, and described in the following specification, are simply exemplary embodiments of the inventive concepts defined in the appended claim. Hence, specific dimensions and other physical characteristics relating to the embodiments disclosed herein are not to be considered as limiting, unless the claims expressly state otherwise.

Figure 1:
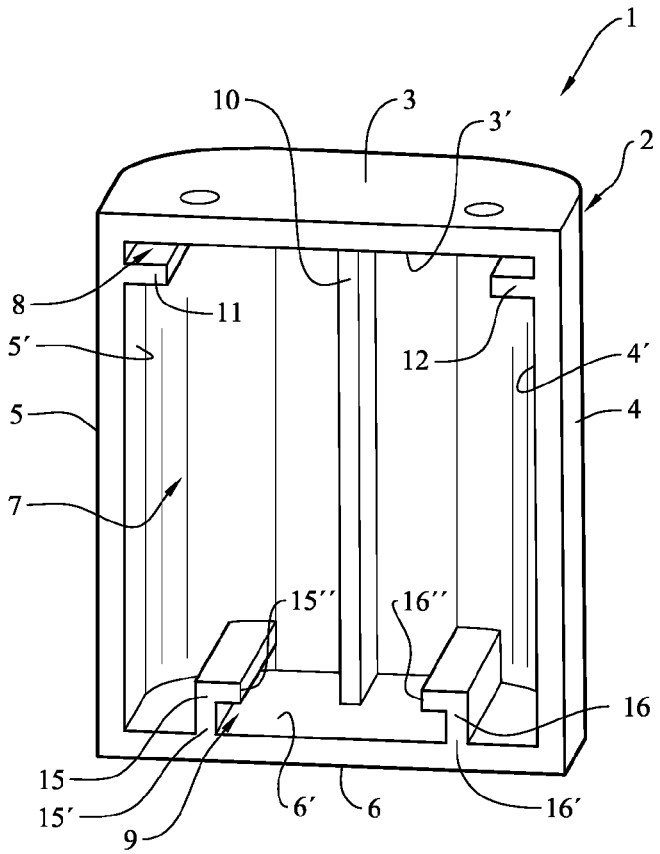
FIG. 1 is a general perspective view of the protective device for covering the tip of beams in accordance with the present invention.
Figure 2:
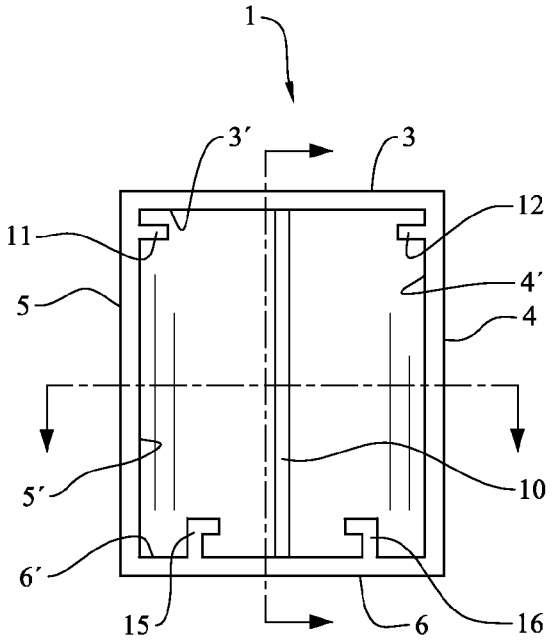
FIG. 2 is a front elevational view.

Making reference to FIGS. 1-2, the present invention is referred to a protective device 1 for covering the tip of beams, especially beams used to install air conditioning units. This device 1 comprises a plastic hollow piece including an external smooth surface protection 2, an upper wall 3, two parallel lateral walls 4-5 and a lower wall 6. Between said walls 3 to 6, an internal chamber 7 is defined. This chamber 7 defines a space into which the tip of a beam is inserted, as will be explained in detail below.

In this chamber 7, an upper channels 8, a lower channel 9 and a central longitudinal rib 10 are included. These parts are molded as an integral part of the device.

The upper channel 8 is defined by two flat faced ribs or projections 11-12 projected from the internal face 4'-5' of each lateral wall 4-5, next to the inner face 3' of the upper wall 3. Therefore, between the ribs 11-12, the lateral walls 4-5 and the upper wall 3 respective grooves or channels 8 and 9 are defined into which the flange of a beam is inserted.

In turn, the lower channel 9 is defined by two L-shaped faced profiles 15-16. Each one has an end 15'-16' attached to the internal face 6' of the lower wall 6 while the other end 15"-16" remains free. In this case between the inner face 6' of the lower wall 6 and the L-shaped profiles, the channel 9 is defined.

The central longitudinal partition 10 comprises a flat centrally-located wall perpendicular to the upper and lower walls. When the beam is inserted in the device 1, this partition 10 has the function of keeping the sharp edges of the beam away from the external wall 2 of the device 1 so as to give some reassurance to the user that even though a strong contact is made with the covered tip of the beam, no injuries will occur; as will be explained in detail below.

The present protective device 1 may be made of different materials, but without introducing limitations to the scope of protection of the present invention, it may be made of thermoplastic material, particularly acrylonitrile butadiene styrene (ABS). In order to dye the thermoplastic material used and to give it a better appearance, pigments may also be added to the thermoplastic material.

Figure 3A:
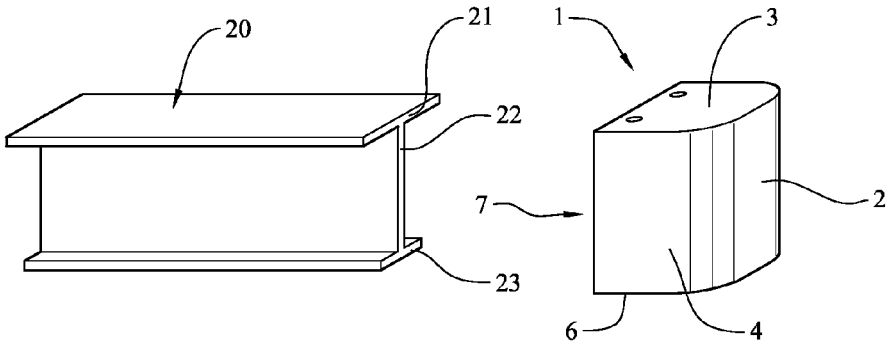
FIG. 3A is a general perspective view showing an I-beam and the device of the present invention.

Making reference now to 3A, 3B and 3C, the way the present device 1 is inserted in the tip of a beam and the way it looks once installed is clearly illustrated. In FIG. 3A, a beam 20 is shown, with an upper flange 21, a central web 22 and a lower flange 23. In turn, the device 1 comprises an upper wall 3, a lateral wall 4, a lower wall 6 and an internal chamber 7.

Figure 3B:
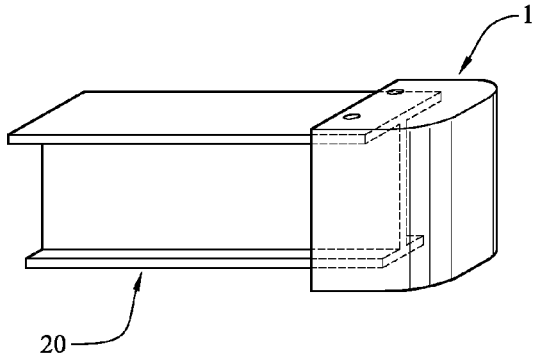
FIG. 3B is a perspective view showing the device inserted in the tip of the beam.

FIG. 3B shows the device 1 inserted in the tip of the beam 20. Broken lines show the tip of the beam located in the device 1. In this figure, it is clear that the central partition 10 prevents the edge of the flanges 21-23 from being in contact with the internal face of the device 1. If a person accidentally hits the covered tip of the beam 20 hard enough, then this partition 10 will bump against the web 22 preventing the sharp edge of the flanges 21-23 to break through the material of the device 1 and injure the person.

Figure 3C:
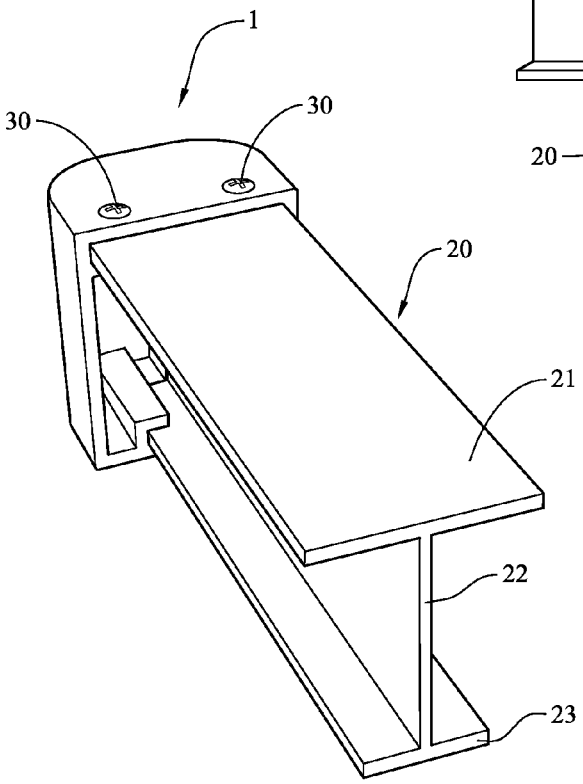
FIG. 3C is a general perspective view showing in detail how the device is fitted in the beam and secured with screws.
Figure 4:
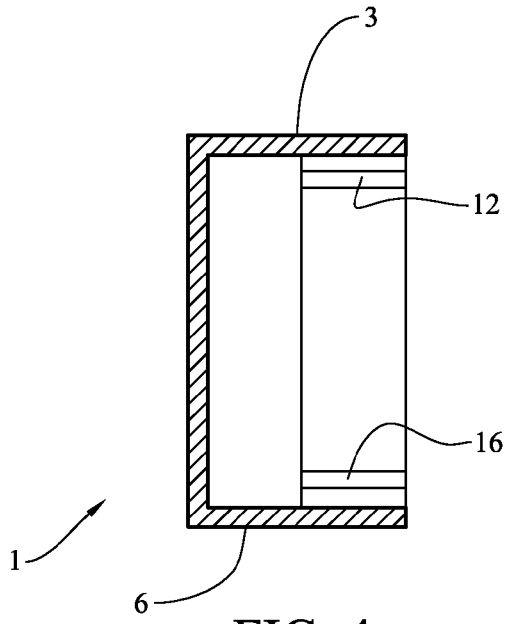
FIG. 4 is a cross sectional view in accordance with A-A of FIG. 2; and finally.
Figure 5:
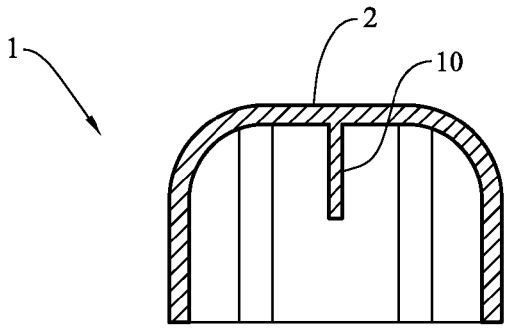
FIG. 5 is a cross sectional view in accordance with B-B of FIG. 2.

FIG. 3C shows the present device 1 installed onto the tip of a beam 20. Holding means 30 may be used to secure the device 1 to a beam 20. In this particular example, the holding means 30 are screws.

While the preferred embodiments of the invention have been described above, it will be recognized and understood that various modifications can be made in the invention and the appended claims are intended to cover all such modifications which may fall within the spirit and scope of the invention.

I claim:

1. A protective device for covering an end of an I-beam, the protective device comprising:

a hollow piece formed of a polymeric material, said hollow piece having a smooth face with an upper wall extending transversely inwardly from said smooth face and a pair of lateral walls extending transversely inwardly from said smooth face and a lower wall extending transversely inwardly from said smooth face, said pair of lateral walls extending between said upper wall and said lower wall, said upper wall and said lower wall and said pair of lateral walls defining an internal chamber, said hollow piece having an upper channel defined by a pair of flat faced ribs extending inwardly respectively from said pair of lateral walls in spaced relation to said upper wall, said hollow piece having a lower channel defined by a pair of inverted L-shaped profiles extending toward the upper wall from said lower wall in spaced relation to said pair of lateral walls, said hollow piece having a central longitudinal partition extending in transverse relation to said smooth face and inwardly into said internal chamber, said central longitudinal partition positioned between said pair of flat faced ribs and between said pair of inverted L-shaped profiles, said upper channel suitable for receiving a flange of the I-beam therein, said lower channel suitable for receiving another flange of the I-beam therein, said central longitudinal partition suitable for abutting a web at an end of the I-beam.

2. The protective device of claim 1, said central longitudinal partition extending substantially perpendicular to said upper wall and said lower wall.

3. The protective device of claim 1, said hollow piece formed of a thermoplastic material.

4. The protective device of claim 3, said thermoplastic material being an acrylonitrile butadiene styrene.

5. The protective device of claim 3, said thermoplastic material having pigments therein.

6. The protective device of claim 1, further comprising:

a holding means for fixedly attaching said hollow piece to the end of the I-beam.

7. The protective device of claim 6, said holding means being screws.

* * * * *